US010704487B2

(12) United States Patent
Baur et al.

(10) Patent No.: US 10,704,487 B2
(45) Date of Patent: Jul. 7, 2020

(54) METHOD OF CONTROLLING A SOLENOID ACTUATED FUEL INJECTOR

(71) Applicant: DELPHI AUTOMOTIVE SYSTEMS LUXEMBOURG SA, Bascharage (LU)

(72) Inventors: Peter Baur, Trier (DE); Heise Volker, Trier (DE)

(73) Assignee: DELPHI AUTOMOTIVE SYSTEMS LUXEMBOURG SA, Luxembourg (LU)

( * ) Notice: Subject to any disclaimer, the term of this patent is extended or adjusted under 35 U.S.C. 154(b) by 0 days.

(21) Appl. No.: 16/310,519

(22) PCT Filed: Jun. 16, 2017

(86) PCT No.: PCT/EP2017/064780
§ 371 (c)(1),
(2) Date: Dec. 17, 2018

(87) PCT Pub. No.: WO2017/216349
PCT Pub. Date: Dec. 21, 2017

(65) Prior Publication Data

US 2019/0145335 A1 May 16, 2019

(30) Foreign Application Priority Data

Jun. 17, 2016 (GB) ..... 1610548.8

(51) Int. Cl.
*F02D 41/20* (2006.01)

(52) U.S. Cl.
CPC ..... *F02D 41/20* (2013.01); *F02D 2041/2003* (2013.01); *F02D 2041/2017* (2013.01); *F02D 2041/2037* (2013.01); *F02D 2041/2051* (2013.01); *F02D 2041/2058* (2013.01)

(58) Field of Classification Search
CPC ..... F02D 41/20; F02D 2041/2058; F02D 2041/2051; F02D 2041/2037; F02D 2041/2017; F02D 2041/2003
USPC ..... 123/478, 490; 701/103–105; 73/114.47
See application file for complete search history.

(56) References Cited

U.S. PATENT DOCUMENTS

| | | | | |
|---|---|---|---|---|
| 7,273,038 | B2 * | 9/2007 | Hayakawa | F02D 41/20 123/478 |
| 9,376,982 | B2 * | 6/2016 | Itaya | F02D 41/20 |
| 2006/0137661 | A1 | 6/2006 | Hayakawa | |
| 2009/0288640 | A1 * | 11/2009 | Shingu | F02M 51/0671 123/472 |
| 2011/0251808 | A1 | 10/2011 | Serra et al. | |
| 2011/0273812 | A1 | 11/2011 | Beer et al. | |

(Continued)

FOREIGN PATENT DOCUMENTS

DE 102010041320 A1 3/2012

*Primary Examiner* — Hai H Huynh
(74) *Attorney, Agent, or Firm* — Joshua M. Haines

(57) ABSTRACT

A method of controlling the operation of a solenoid activated fuel injector, actuator being operated by applying a activation pulse profile to the solenoid. The method includes measuring the voltage across, or current through, the solenoid during a time period of the valve closing phase, subsequent to a valve opening phase. The method also includes determining at least one parameter from the measuring step. The method also includes controlling and varying the activation pulse profile during a subsequent activation/fueling cycle of the fuel injector based on the parameter.

12 Claims, 9 Drawing Sheets

(56) References Cited

U.S. PATENT DOCUMENTS

| | | | | |
|---|---|---|---|---|
| 2013/0073188 | A1 | 3/2013 | Rsel | |
| 2013/0104636 | A1 | 5/2013 | Beer et al. | |
| 2013/0139791 | A1* | 6/2013 | Kusakabe | F02M 69/04 123/478 |
| 2014/0012485 | A1 | 1/2014 | Brandt et al. | |
| 2014/0311459 | A1 | 10/2014 | Katsurahara | |

* cited by examiner

METHOD OF CONTROLLING A SOLENOID ACTUATED FUEL INJECTOR

CROSS REFERENCE TO RELATED APPLICATIONS

This application is a national stage application under 35 U.S.C. 371 of PCT Application No. PCT/EP2017/064780 having an international filing date of Jun. 16, 2017, which is designated in the United States and which claimed the benefit of GB Patent Application No. 1610548.8 filed on Jun. 17, 2016, the entire disclosures of each are hereby incorporated by reference in their entirety.

FIELD OF THE INVENTION

This disclosure relates to methods of controlling actuation of fuel injectors. It has particular but not exclusive application to a method of controlling the closing of solenoid controlled fuel injector valves after an initial opening.

BACKGROUND

Solenoid actuated fuel injectors typically are controlled by pulses sent to the actuator of a fuel injector solenoid which act to open a fuel injector valve and allow fuel to be dispensed. Such actuators act to displace (via the armature of the actuator) a pintle and needle arrangement of the valve, to move the needle away from a valve seat. In such a state, the valve is open and when the pulse falls there is no power to the actuator and the valve is forced to a closed position.

Pulse profiles may vary and may comprise a series of pulses to operate the solenoid. There may be an initial activation (boost) pulse, provided in order to start to move the needle away from the valve seat, thereafter the pulse and thus power to the actuator is reduced—so therefore after a short while this may be followed by a "hold" phase where a reduced level of power is applied to keep the valve in the open position. These pulses may be regarded as fueling pulses. Thereafter the pulse and this voltage is reduced to close the valve. This may be followed by one or more braking pulses which act to slow the movement of pintle and needle when closing.

So to recap, in order to allow a robust opening, solenoid driven (e.g. gasoline direct) injectors are typically powered up with a slight excess of electric energy to the solenoid coil. The coil is energized in a first phase with a boost voltage to accelerate the armature from close to open. Typically such first phase is followed by a second well defined energy supply (or "hold") phase, which is characterized to hold the reached open position of the valve for a desired time.

A development trend is to reduce the time from close to open and vice versa of the solenoid driven valve and imitate the performance of competing piezo driven injector valves at significant lower cost. The objective is to dispense precisely lower fuel mass quantities. At very low fueling instances the solenoid driven valve operates in a so called transitional mode as opposed to ballistic or linear mode, which means that the valve will not settle in open position but moves partially towards closing prior to reach steady-state open position. If the closing is initiated during such bouncing it causes dynamically varying closing speeds of the pintle and armature. As a consequence it causes non-linear fueling in relation to the stimulus. Furthermore speed depending dynamic friction is considered to be one cause of accelerated wear, stimulating observable stick-slip effects of the moving parts and can be caused by varying closing speeds stimulated by bouncing. Likewise it comprises insuperable part to part variations if not addressed with significant computational efforts (ICLC). These prior art apparatus have significant part to part fuel variations during this so called transitional phase which limits the usability under these conditions and draw thereby a distinct line of differentiation to competing (piezo) injector propulsion technologies. The technical aspect to address is to control the supply driving schedule of the coil and thereby the speed of the armature and pintle during the transition from close to open and thereby reducing the momentum for bouncing.

It is an object of the invention to overcome these problems.

STATEMENT OF THE INVENTION

In one aspect is provided a method of controlling the operation of a solenoid activated fuel injector, said actuator being operated by applying a activation pulse profile to said solenoid, comprising: a) measuring the voltage across, or current through, the solenoid during a time period of the valve closing phase, subsequent to a valve opening phase; b) determining at least one parameter from step a); c) controlling and varying the activation pulse profile during a subsequent activation/fuelling cycle of said fuel injector based on the parameter of step b).

Step b) may comprise the steps of i) summing said voltage or current over said time period; and step c) may comprise ii) controlling and varying the activation pulse profile during a subsequent activation/fuelling cycle of said fuel injector based on sum form step i).

In step i) the summed voltage or current may provide a measure of average closing speed.

Step ii) may comprise varying the energy of an initial activation/boost pulse of said activation pulse profile.

Step ii) may comprise varying the magnitude or duration of the initial activation/boost pulse of said activation pulse profile.

Step i) may comprises summing the coil-turn-off voltage during a closing phase.

Step ii) may include comparing the determined sum from step b) and comparing with a target value or target band, and varying the activation pulse profile during a subsequent activation/fuelling cycle based on the comparison.

Step ii) may includes reducing the level or duration of said activation pulse if said sum is greater than said target/target band and/or reducing the level or duration of said activation pulse if said sum is greater than said target/target band.

In step b) the parameter may be the time it takes for the closing voltage (voltage decay) to reach a voltage threshold.

BRIEF DESCRIPTION OF DRAWINGS

The invention will now be described by means of examples and with reference to the following figures of which:

FIG. 1 shows a typical activation pulse 1 sent to a solenoid controlled fuel injector during a fuelling (operating) cycle. The parameter shown is voltage e.g. applied across the solenoid terminals. As can be seen there is an initial high activation or "boost" pulse 2. This pulse acts to provide the force needed to move/accelerate the armature/pintle arrangement away from its closed position to an open position. After this is a lower hold phase (pulse) 3 where a low voltage is applied to keep the valve in the open position. After this the voltage is reduced (negative pulse applied) and the valve starts to close. During this time the voltage across the solenoid terminals decays.

As mentioned at very low fueling instances the solenoid driven valve operates in a so called transitional mode as opposed to ballistic or linear mode, which means that the valve will not settle in open position but moves partially towards closing prior to reaching steady-state open position. If the closing is initiated during such bouncing it causes dynamically varying closing speeds of the pintle and armature. As a consequence it causes non-linear fueling in relation to the stimulus (i.e. pulse profile parameters). This is shown in FIG. 2*a*. FIG. 2*a* shows the pintle displacement against time for different pulse widths. Plots designated with reference numeral 4 shows the operation in a ballistic mode, reference numeral 5 shows movement in a transition mode and reference numeral 6 shows movement in a linear mode. The excess of coil excitation (e.g. for high pulse widths) leads to high impact speed of the armature/pintle at the fully open end stop.

Figure 2A:
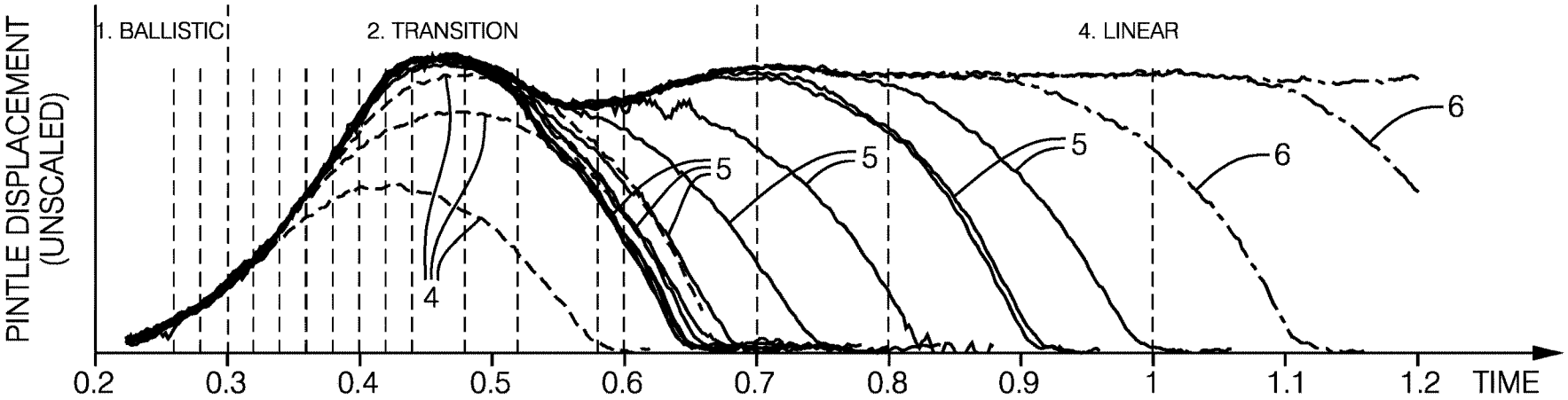
FIG. 2*a* shows the pintle displacement against time for different pulse widths.
Figure 3A:
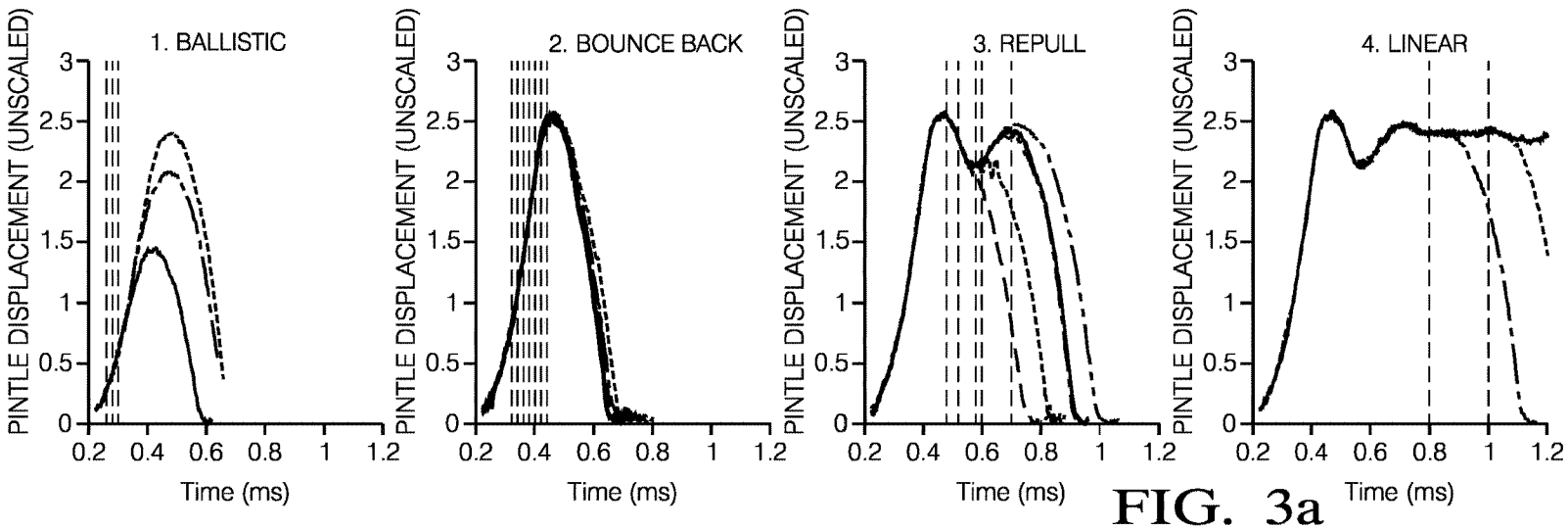
FIGS. 3*a* and *b* shows a further representation of the phases of the flow curve, and show similar plots as for FIGS. 2*a* and 2*b;*
Figure 3B:
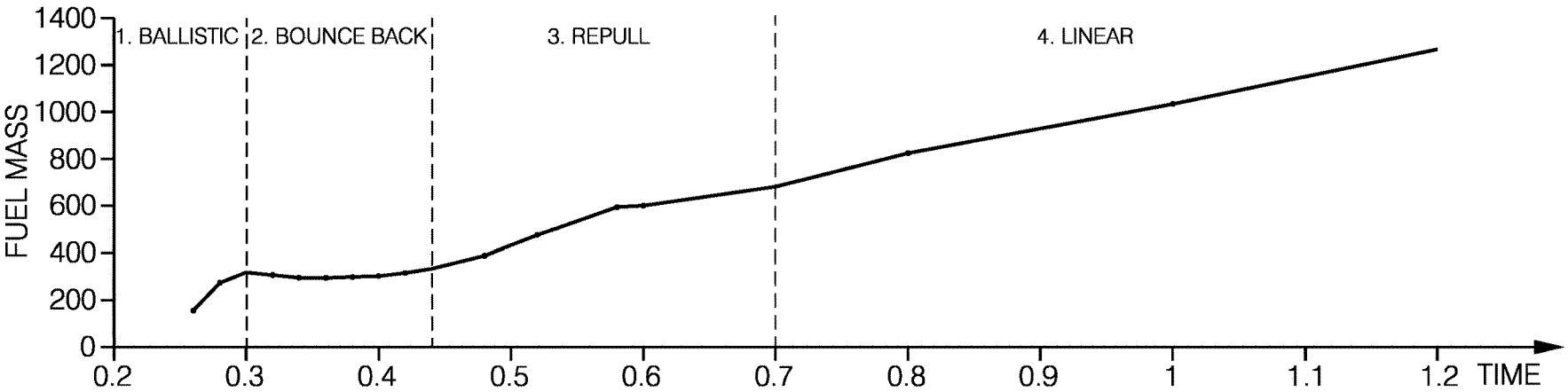
Figure 4A:
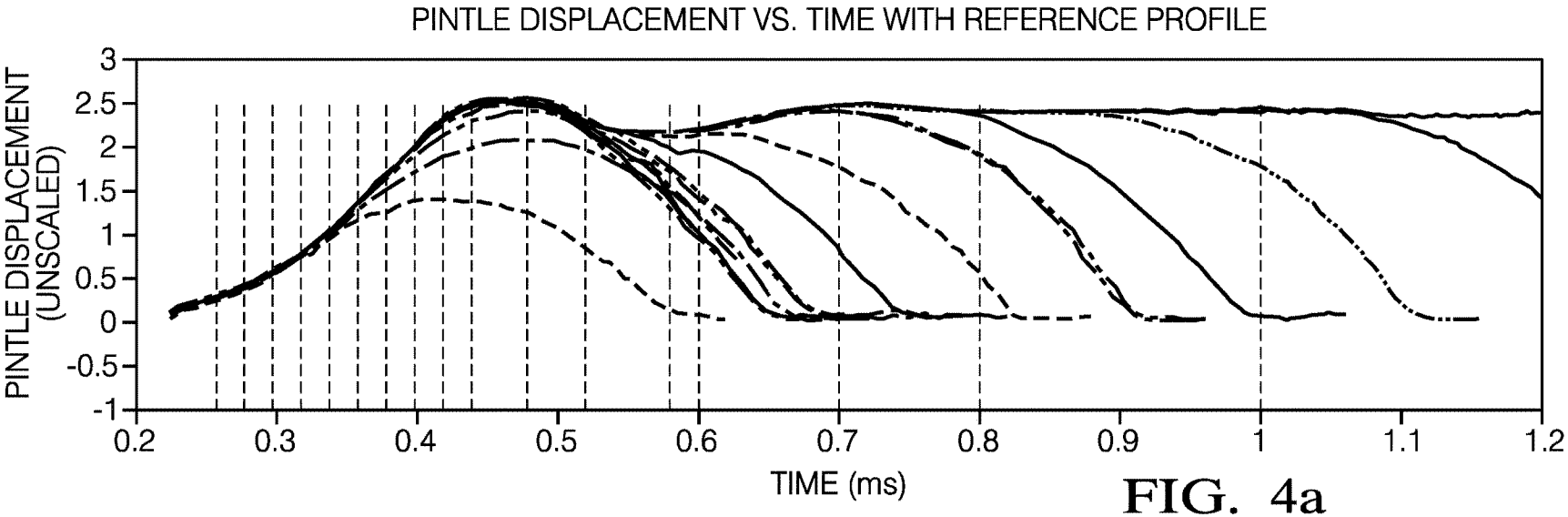
FIGS. 4*a* and *b* shows pintle displacement curves for different pulse widths with different activation schemes.
Figure 4B:
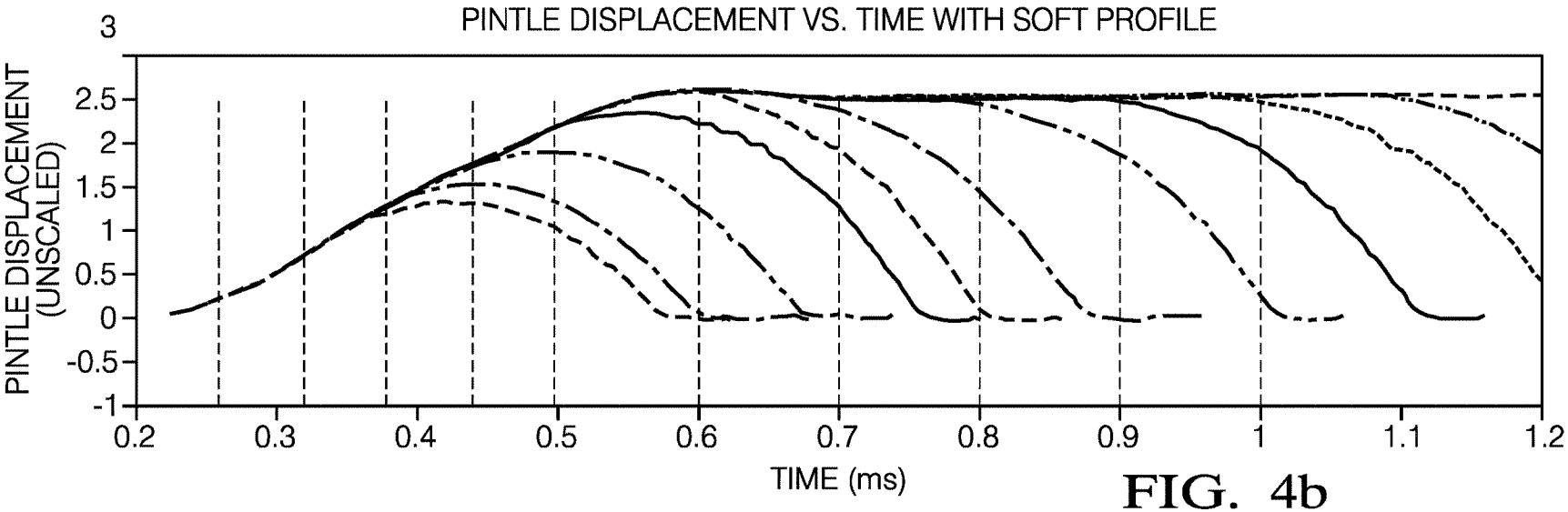

Due to the momentum, the pintle will bounce back from this opening position—see FIGS. 2*a*, 3*a* and 4*a*.

For longer opening times the Lorenz force caused by the electric current will pull the armature/pintle back to the open position and reaches thereby steady state open conditions.

Figure 2B:
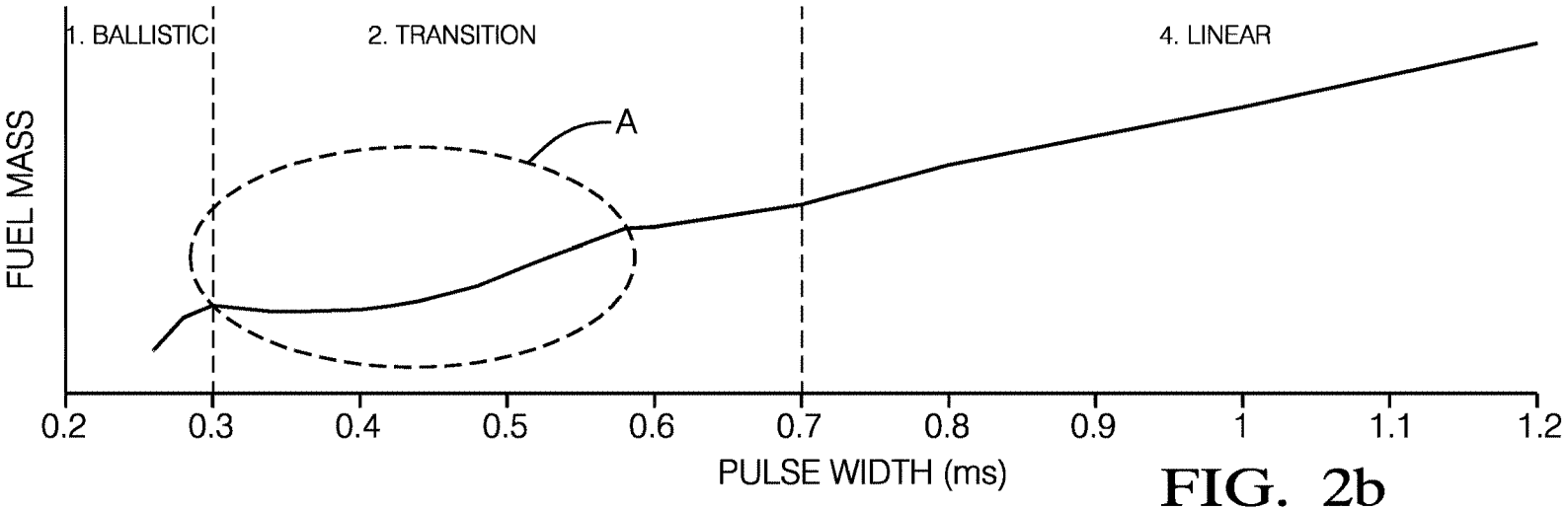
FIG. 2*b* shows the fuel mass dispensed against pulse width (activation/boost pulse) for the corresponding conditions/pulse widths of FIG. 2*a;*

FIG. 2*b* shows the fuel mass dispensed against pulse width (activation/boost pulse) for the corresponding conditions/pulse widths of FIG. 2*a*. During the transition between the so called ballistic mode (short injection pulses), where the pintle does not reach yet the full opening stroke, and the linear mode, the bouncing of the pintle causes the (injected) fuel mass/pulse width curve to have particular non-linear relationship in this region, and is characterized sometimes as non-biunique characteristic fuel-mass curve. This is sometime referred to as the spoon effect as shown in the region of the curve bounded by zone A of FIG. 2*b*.

FIGS. 3*a* and *b* shows a further representation of the phases of the flow curve, and show similar plots as for FIGS. 2*a* and 2*b*.

As mentioned, this low quantity fueling behavior is known and is called "spoon effect" (shown by circle A in FIGS. 2*b*/3*b*) and part of each fuel-mass curve—the spoon effect is detrimental in that it causes non-linearity in the relationship between fuel dispensed and pulse width. The standard solution and work around is to extract the electric current and/or voltage from the propulsion coil. With these means phenomenological models (simple cascaded low pass filters) are applied to predict an averaged arbitrary but unique closing event (Parameter 1) and predict a minimum fuel delivery pulse-width (Parameter 2). Whereas this second parameter describes the numerical achievable technical limit of the first parameter. The result is sufficient to a limited group of similar injector valves at most similar environmental conditions. The minimum delivered pulse is experimentally found out of a series of small pilot pulses prior to a main delivery pulse per injector and during engine operation. It is sufficiently unique to surrogate it with an opening detection event. The fueling is thereafter a function of the timestamp of the found surrogate and closing time. This is not ideal.

FIG. 4*a* shows pintle displacement curves for different pulse widths: the upper chart with standard drive scheme, the lower chart: with reduced actuation energy (manually adjusted). The bottom chart (4*b*) shows the pintle displacement curves with a profile with reduced peak current The problem is the robustness of fueling within the transition phase with bouncing. Furthermore the problem to find suitable calibration parameters for larger population of injectors at a meaningful low fueling level. Finally the root cause is not addressed.

The detrimental effect has been attempted to be alleviated by algorithms to detect the variation of closing time caused by this effect either by analyzing the second derivative of the injector voltage during closing and extracting thereby the time-instance of a technical jerk or by analyzing a high frequency pressure sensor signal. It serves as long term life corrections.

DETAILED DESCRIPTION OF THE INVENTION

Aspects of the invention provide for control of the injector current of the applied source (i.e. pulse profile) to reduce excessive energy during opening while still guarantee the proper opening of the pintle. In examples, the level and/or duration of the activation (boost pulse) is varied.

Figure 1:
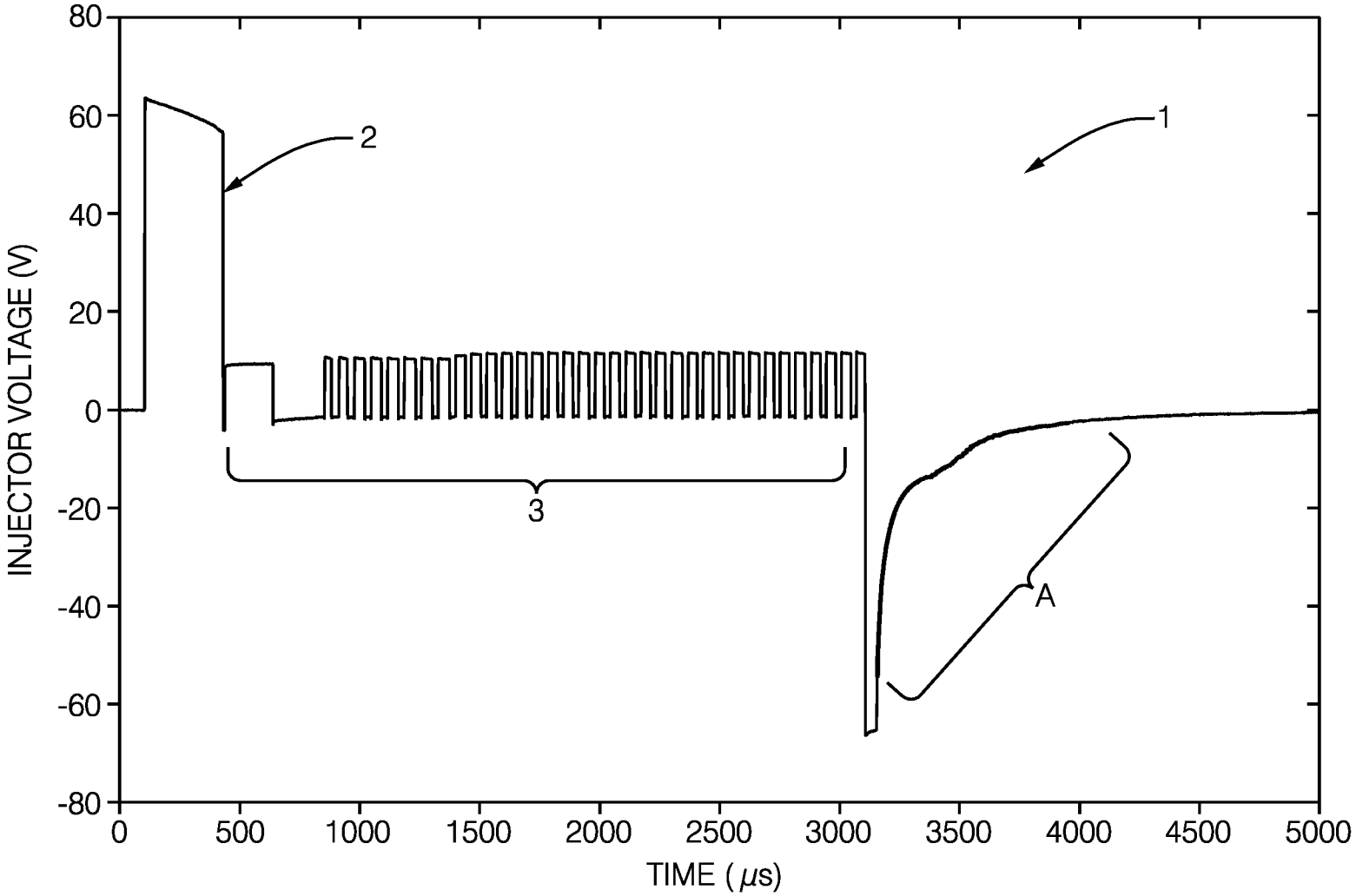
FIG. 1 shows a typical activation pulse.
Figure 5:
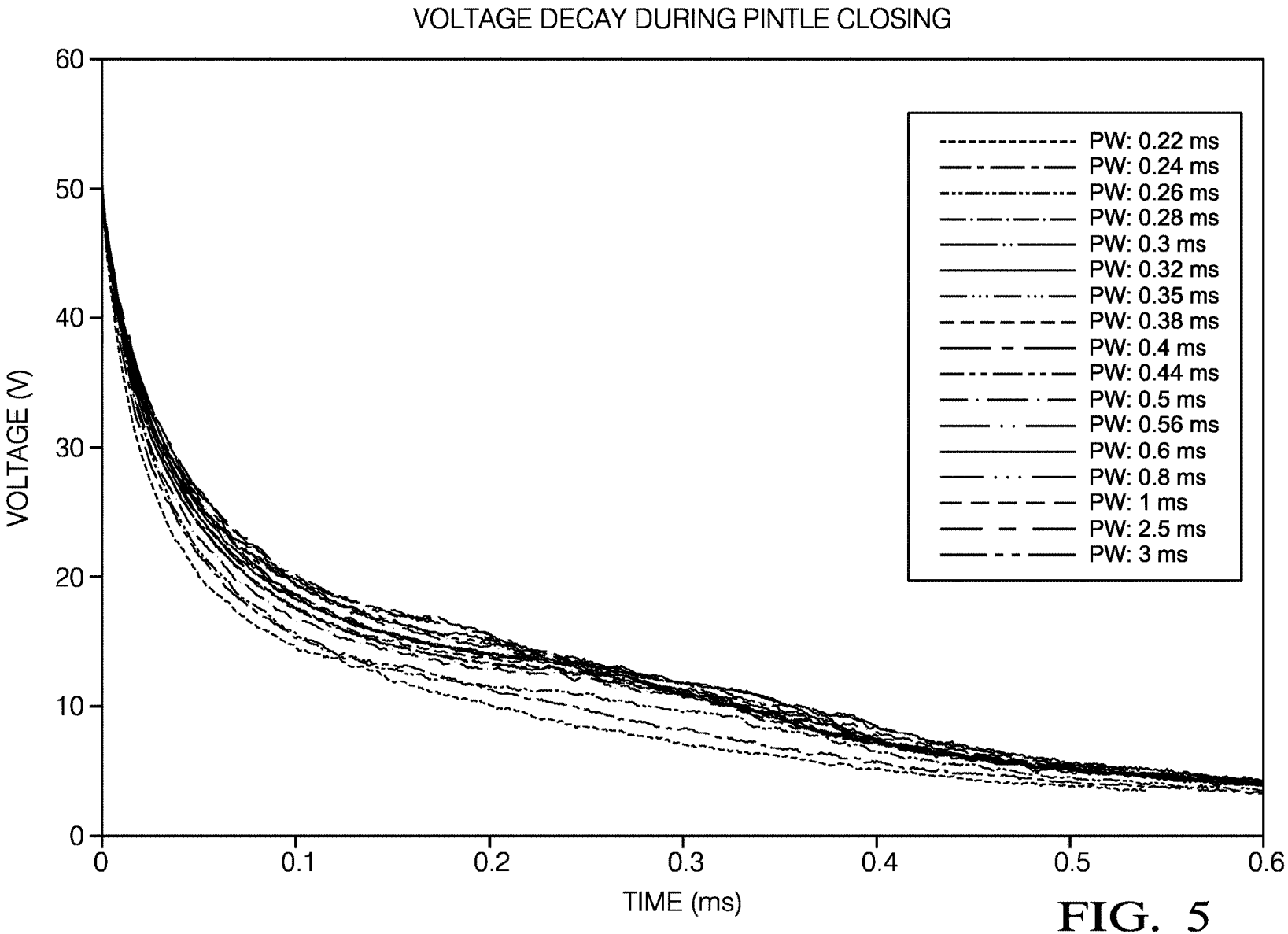
FIG. 5 shows voltage decay curves for different injector activation times (pulse widths)

In one aspect this feedback information is provided by analyzing the coil-turn-off-voltage during a closing phase. During coil-turn-off event the stored magnetic energy naturally decays and the Lorenz force induces an additional, speed proportional voltage—see FIG. 5 shows a plot of the closing voltage (decay) which is inverted for clarity for different pulse widths (this is effectively the region A from FIG. 1 expanded in more detail). Thus the plot shows voltage decay curves for different injector activation times (pulse widths).

In a simple embodiment feedback information is compiled by sampling the voltage during this closing/decay event and integrating the voltage/current (across or thorough the solenoid terminals) over a time period; i.e. determining a voltage sum. This voltage sum has been determined to be proportional to an average closing speed (ACS). The ACS has been determined to be constant at long pulse-width and has a strong overshoot when bouncing plays a role. Furthermore it is fading out at pulse-widths where no fuel is delivered, respectively where the valve does not open, but electric energy was supplied to the coil. This will be explained more detail later with reference to FIG. 7. So in aspects of the invention the characteristics of opening (phase) are determined from characteristics of closing e.g. in particular the integral of the voltage during the decay (closing phase)

The average closing speed or a measure of this determined by the integration described, provides useful information on the nature of the opening, in particular bouncing.

In essence, in basic example, the level of the boost voltage/current (of the activation pulse of the pulse profile) applied to the actuator, and/or its duration, for the opening phase, is varied according to the measure of average closing speed, or in other words varied according to the measured voltage sum determined during an appropriate time window of the closing/decay event. The width of the activation (boost) pulse or its magnitude (height) can be varied in order that the voltage sum during closing is within a threshold band.

Figure 6:
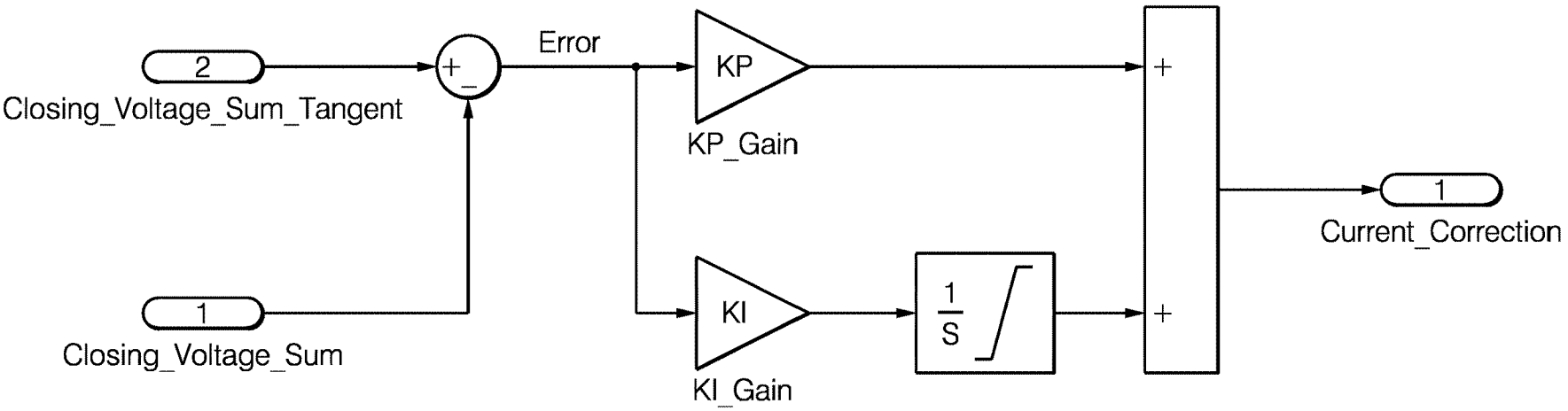
FIG. 6 shows a block control diagram showing an example of how aspect may be implemented.

The overshoot zone is the zone where the supplied peak driving current can be reduced or increased to meet the set-point by any suitable control. FIG. 6 shows a block control diagram showing an example of how aspect may be implemented. The voltage sum during the closing/decay phase is measured or determined and compared to a target value. Any discrepancy i.e. difference is used to adjust the level or width of the activation pulse. Proportional and Integral Control (PI-control) may be applied but the skilled person would be readily aware of other control schemes that may be used.

The result is a controlled energy supply to the solenoid propulsion, with controlled momentum during the transitional phase and thereby effects elimination of the root cause for the pronounced nonlinearity while dispensing low fuel quantities. The control actuations can be applied e.g. chronologically after analyzing the coil-turn-off-voltage and extracting ACS e.g. at higher actuation times. Control means here corrected for a subsequent (following) pulse and not closed loop for the actual pulse. In other words there is a learning phase for one or more pulses and a subsequent pulse is controlled according to the information/feedback from the previous pulse(s).

In a particular example, after turning off the energy supply to the coil a dedicated mechanism of the electronic control board can recover most of the stored magnetic energy of the coil into a storage capacitor through a diode. The remaining coil voltage decays further to steady state at zero volt across the coil. The armature movement during this event induces a speed proportional voltage. According to an aspect, control of a constant set-point using the ACS serves therefore as momentum impact speed control (MiSC).

Mathematical Background

An injector propulsion must satisfy for any activation the relation of Equation 1. It means the supplied energy to the coil must be large enough to satisfy intrinsic energy storages, losses and still provide its primary function of moving the armature and pintle mass in target time from zero position, valve closed position, to full stroke, valve open position, equation 2.

$$E_{in} > E_{stored} \quad \text{Equation 1}$$

$$\int U_{boost} * i_{boost}(t)dt + \int U_{hold} * i_{hold}(t)dt - \int P_{ohm}dt - \int P_{friction}dt > \tfrac{1}{2}kx^2 + \tfrac{1}{2}mv^2 + \tfrac{1}{2}Li^2 \quad \text{Equation 2}$$

In case the armature and pintle reach the desired valve open position at the desired time, than the associate mass is liberating the previous stored kinetic energy, because an abrupt change from maximum v=vmax to v=0 speed. With the assumption, that the kinetic energy is transformed into a momentum (Equation 3) an additional transient force (Equation 4) is acting in the direction of the spring force.

$$p = \sqrt{2mE_{kin}} \quad \text{Equation 3}$$

$$F_{momentum} = \frac{dp}{dt} \quad \text{Equation 4}$$

The equilibrium of forces at this transitional phase is described in Equation 5.

$$F_{momentum} + F_{spring} = F_{magnetic} \quad \text{Equation 5}$$

If the valve is switched off (Fmagnetic=0) than the Equation 5 describes the starting boundary conditions for the movement from open to close and influences a peak closing speed. This maximum closing speed is therefore a dependable function of the momentum at the time instant of the valve turn-off event.

The average closing speed can be measured during the coil turn-off phase using the basic electric relation of Equation 6.

$$V(t) = \frac{\partial \text{Flux}}{\partial \text{gap}} \frac{dgap}{dt} + \frac{\partial \text{Flux}}{\partial i} \frac{di}{dt} \quad \text{Equation 6}$$

The equation 6 describes the decaying voltage across a depleting magnetic field of a coil, while the armature is moving and is contributing with an induced voltage. The Equation 7 is a transformation of Equation 6, while replacing the gap change in time with the closing speed of the armature and pintle. In case the closing speed reaches v=0, than the measurable remaining voltage across the coil is caused by the still not fully depleted magnetic field.

$$V(t) = \frac{\partial \text{Flux}}{\partial \text{gap}} v_{closing} + \frac{\partial \text{Flux}}{\partial i} \frac{di}{dt} \quad \text{Equation 7}$$

By calculating the sum of all voltage data point during this phase, then an average closing speed can be named, Equation 8.

$$\sum V(t) = \sum \left( \frac{\partial \text{Flux}}{\partial \text{gap}} v_{closing} + \frac{\partial \text{Flux}}{\partial i} \frac{di}{dt} \right) = \overline{v_{closing}} + v_0 \quad \text{Equation 8}$$

This average closing speed can be calculated for any injector pulse by simply summing the closing voltage. Aspects of the invention use this characteristic as a feedback signal to control and influence the input energy by changing the input opening current.

It was observed that the movement of the armature changes the shape of the voltage decay during the coil-turn-off phase (see FIG. 5). A higher armature speed creates a stronger inflection in the voltage curve. When the injector is turned off such that the magnetic force is fading out just after the pintle hits the fully open end stop, it is accelerated by the spring force and momentum. This leads to a higher closing speed resulting in a more powerful inflection in the voltage curve.

Further Example

Figure 7A:
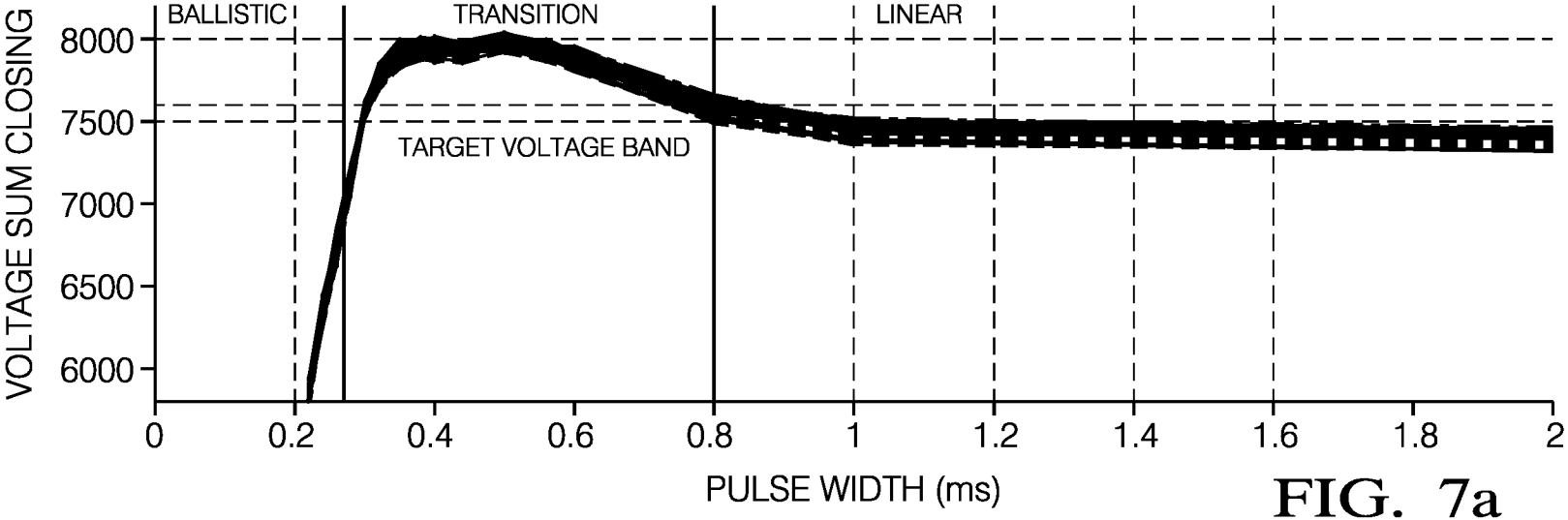
FIG. 7*a* which shows how the sum of voltage during closing/decay varies with actuation versus pulse width.
Figure 7B:
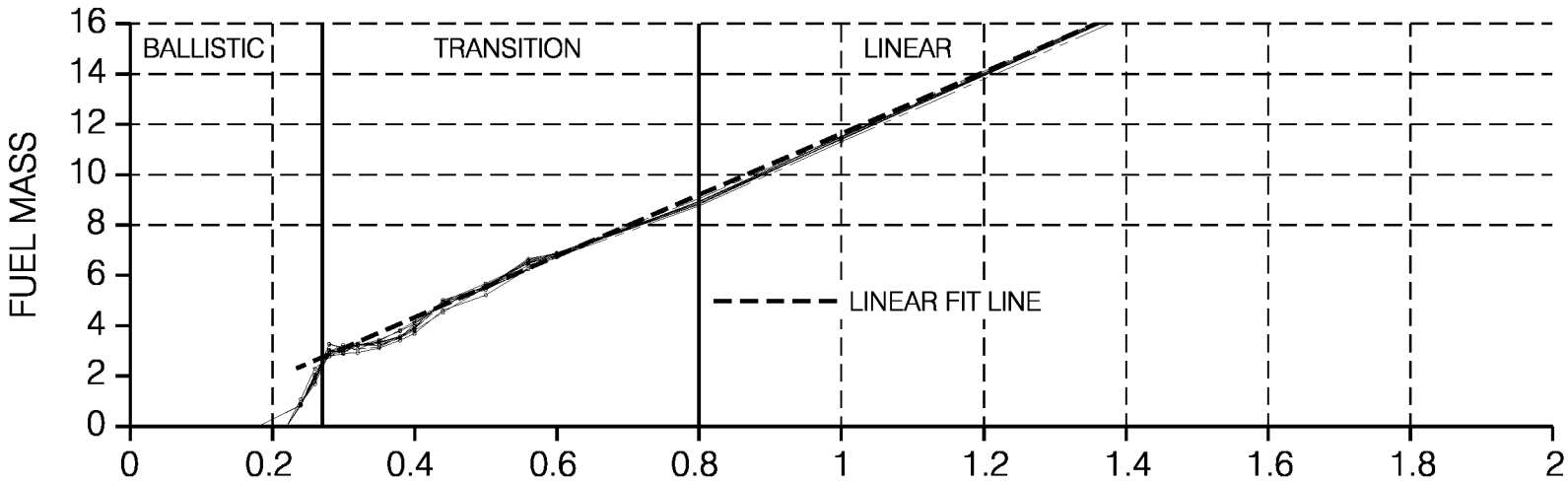
FIG. 7*b* shows the corresponding correlation between fuel mass injected and pulse width.

Aspects uses the sum of the injector voltage readings during the closing phase as the control variable—see FIG. 7*a* which shows how the sum of voltage during closing/ decay varies with actuation versus pulse width. As can be seen, a control strategy may be implemented such that the sum of the voltage during closing is within a band, i.e. between strict limits, shown by the dotted lines Y1, Y2. In the figure, this corresponds to a pulse width of e.g. 0.8 ms as shown by the vertical line X. So, in a control algorithms, the injector peak current (or duration) can be adjusted in such a way that the sum of voltage (or current) readings (~average closing speed) remains in a target tolerance band for given pulse widths. This is done by varying the magnitude and/or duration of the activation (boost) pulse. FIG. 7*b* shows the corresponding correlation between fuel mass injected and pulse width.

Determining Target Set—Point Used in the Subsequent Control

As mentioned in examples a measure of the ACS is determined e.g. at high pulse-width and used in feedback control methods to determine the target set-point for each injector. The target voltage sum may be determined by experimentation or other means.

Figure 8:
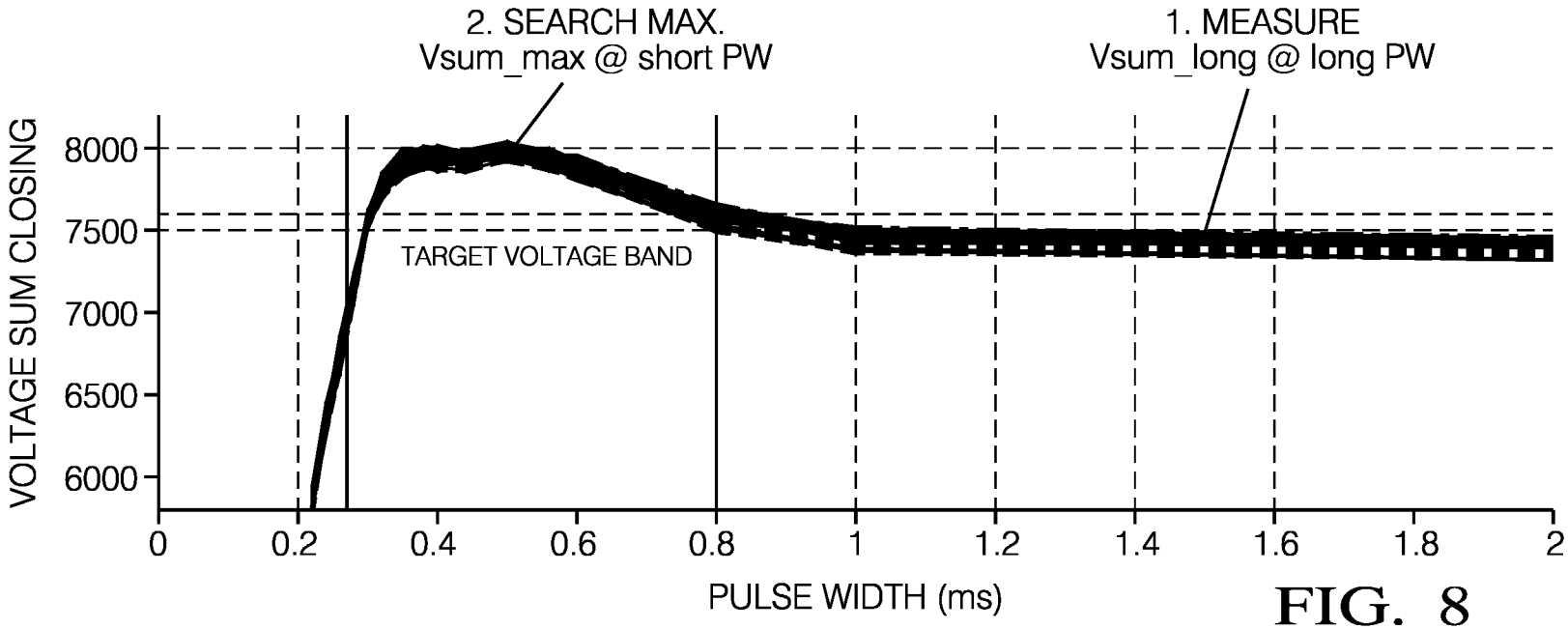
FIG. 8 shows an example of how the target sum may be determined.

FIG. 8 shows an example of how the target sum may be determined. The figure shows voltage sum (closing) against pulse width. In the method, a standard drive scheme is applied. When a pulse of say pulse width e.g. greater than 1.5 ms is applied, the voltage sum (Vsum_long) is measured. When the pulses are short say 0.3 to 1 ms are commanded the maximum measured voltage sum (Vsum_max) is determined. The target voltage sum may be estimated from these data. In an example the target sum voltage is given as:

$$V\text{sum_target}=V\text{sum_long}+(V\text{sum_max}-V\text{sum_long})*K_V\text{sum_safety_factor}$$

Aspects of the invention reduce the bouncing effect by reducing the coil current and thereby keep the closing time constant. The target closing voltage sum can be determined for each injector during the linear phase of the flow curve and the feedback voltage sum can be calculated out of low side injector voltage measurement as it is already implemented in many controllers today. The voltage sum is proportional to closing speed. It can be determined either via software or in a hardware integration circuit with controllable reset. The correlation between closing speed and impact speed can be derived by using a momentum model during opening bouncing caused by the excess of supplied energy.

Prior art methods of compensation of pulse-width in order to correct fuel mass non-linearity caused by the different closing speeds after bouncing, typically measure the decaying voltage and extract the closing time event based on a phenomenological model using characteristic elements (zero crossing, plateau flat-width . . . ) of the low pass filtered second derivative curvature of the voltage. In case such characteristic element is calculated below a threshold this indicates the limit of the phenomenological model and is used to define the least controllable fuel mass at a minimum delivery pulse. The model parameter values are defined (calibration of algorithm parameter) by changing thresholds and filter-constants to achieve meaningful low fuel mass limits while having a large population of injectors alike. Prior art fuel mass compensation requires extensive computation resources for filtering and derivative calculation in order to determine the closing time. The calibration parameters are extremely sensible to part to part changes of injectors, engine controller units and software coil drive schedules. Aspects of the invention control the closing time with the additional advantages of reducing the wear of the mechanical armature and pintle interfaces due to reduced impact speeds and reduced speed dependent friction and thereby stick-slip effects.

In general any other characteristic signal deducted out of the voltage decay curve during closing can be used as a feedback signal for the peak current control, e.g. the time it takes for the closing voltage (voltage decay) to reach a certain voltage threshold.

Figure 9:
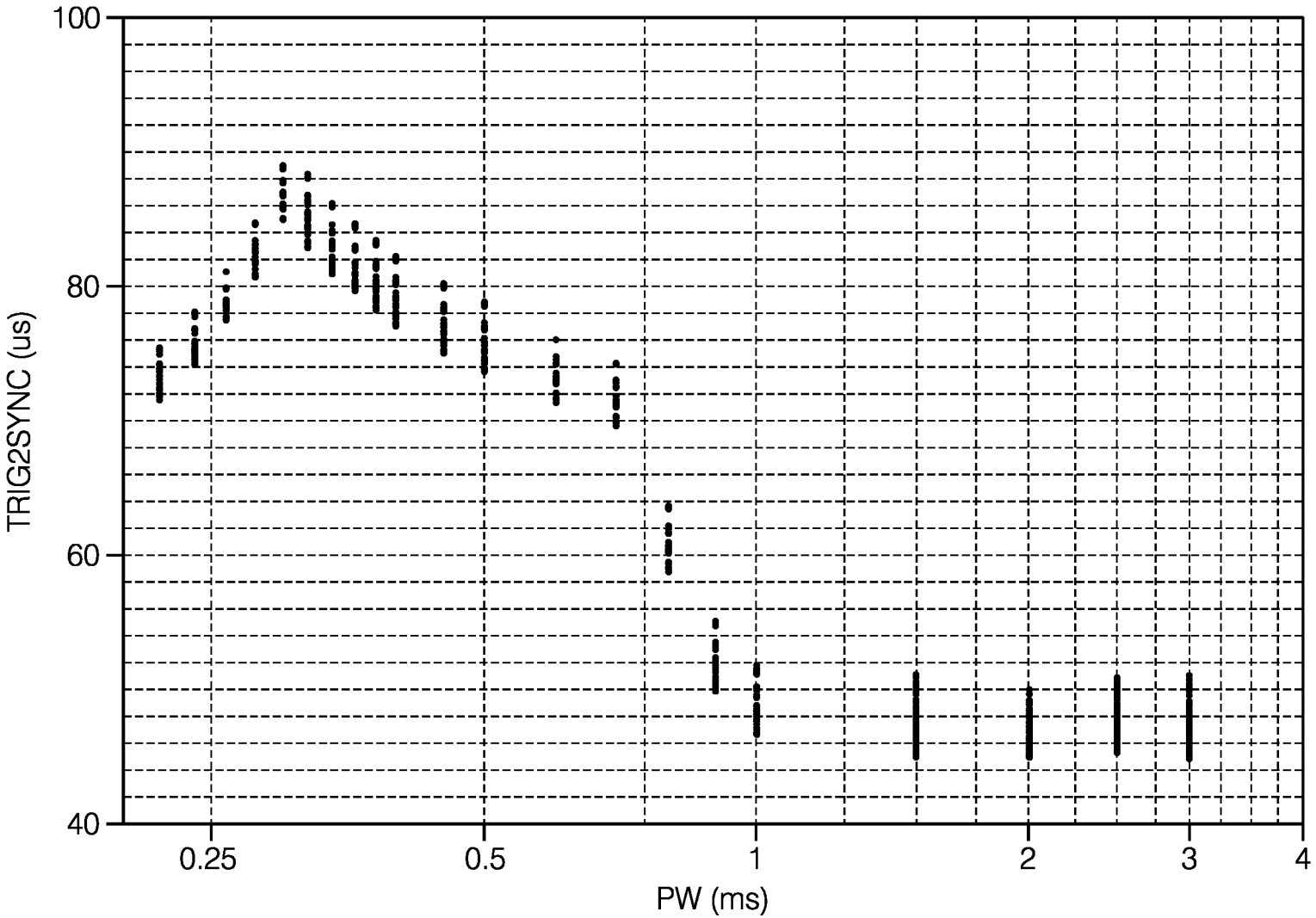
FIG. 9 shows the attached plot shows the distribution of times it takes between end of the pulse until the voltage decay reaches a threshold.

FIG. 9 shows the attached plot shows the distribution of times it takes between end of the pulse until the voltage decay reaches a threshold e.g. 55V (Trig2Sych) for different pulse widths.

The plot of these times versus pulse width is similar to the Vsum curve vs. pulse width.

The invention claimed is:

1. A method of controlling operation of a fuel injector, said fuel injector including a valve actuated by an actuator controlled by a solenoid, said actuator being operated by applying an activation pulse profile to said solenoid, said method comprising:

a) measuring a voltage across, or a current through, the solenoid during a time period of a valve closing phase, subsequent to a valve opening phase;

b) summing said voltage or said current over said time period; and c) controlling and varying the activation pulse profile during a subsequent activation/fueling cycle of said fuel injector based on said sum from step b).

2. A method as claimed in claim 1, where step c) comprises varying energy of an initial activation/boost pulse of said activation pulse profile.

3. A method as claimed in claim 1, where step c) comprises varying a magnitude or a duration of an initial activation/boost pulse of said activation pulse profile.

4. A method as claimed in claim 1, wherein step c) comprises summing the coil-turn off voltage during the valve closing phase.

5. A method as claimed in claim 1, wherein step c) includes comparing said sum from step b) and comparing said sum with a target value or target band, and varying said activation pulse profile (1) during a subsequent activation/fueling cycle based on the comparison.

6. A method as claimed in claim 5 wherein step c) includes reducing a level or a duration of an initial activation/boost (2) if said sum is greater than said target/target band and/or reducing the level or the duration of said initial activation/boost if said sum is greater than said target/target band.

7. A method of controlling operation of a fuel injector, said fuel injector including a valve actuated by an actuator controlled by a solenoid, said actuator being operated by applying an activation pulse profile to said solenoid, said method comprising:

a) measuring a voltage across the solenoid during a time period of a valve closing phase, subsequent to a valve opening phase;

b) summing said voltage over said time period; and c) controlling and varying the activation pulse profile during a subsequent activation/fueling cycle of said fuel injector based on said sum from step b).

8. A method as claimed in claim 7, where step c) comprises varying energy of an initial activation/boost pulse of said activation pulse profile.

9. A method as claimed in claim 7, where step c) comprises varying a magnitude or a duration of an initial activation/boost pulse of said activation pulse profile.

10. A method as claimed in claim 7, wherein step c) comprises summing the coil-turn—off voltage during the valve closing phase.

11. A method as claimed in claim 7, wherein step c) includes comparing said sum from step b) and comparing said sum with a target value or target band, and varying said activation pulse profile during a subsequent activation/fueling cycle based on the comparison.

12. A method as claimed in claim 11 wherein step c) includes reducing a level or a duration of an initial activation/boost if said sum is greater than said target/target band and/or reducing the level or the duration of said initial activation/boost if said sum is greater than said target/target band.

* * * * *